US005674185A

United States Patent [19]

Chang

[11] Patent Number: 5,674,185

[45] Date of Patent: Oct. 7, 1997

[54] SOLE MASSAGING DEVICE

[76] Inventor: Chien-Chung Chang, No. 82, Ho Tso Street, Sun Chung Li, Feng Yuan City, Taiwan

[21] Appl. No.: 580,301

[22] Filed: Dec. 28, 1995

[51] Int. Cl.[6] ..... A61H 15/00

[52] U.S. Cl. ..... 601/122; 601/128

[58] Field of Search ..... 297/423.46, 423.44, 297/423.45; 601/122–128, 118, 119, 129, 130

[56] References Cited

U.S. PATENT DOCUMENTS

| | | | |
|---|---|---|---|
| 2,446,099 | 7/1948 | Niblack | 601/127 |
| 3,155,364 | 11/1964 | Berg | 297/423.46 X |
| 3,859,930 | 1/1975 | Sherwin | 297/423.46 X |
| 4,016,872 | 4/1977 | Yamamura et al. | 601/118 |
| 4,205,663 | 6/1980 | Fujiwara | 601/122 |
| 4,210,135 | 7/1980 | Deuser | 601/129 |
| 4,832,006 | 5/1989 | Kirsch | 601/122 |
| 4,892,090 | 1/1990 | Kaeser | 601/122 X |
| 5,234,396 | 8/1993 | Wilkinson | 297/423.46 X |

FOREIGN PATENT DOCUMENTS

| | | | |
|---|---|---|---|
| 405042186 | 2/1993 | Japan | 601/126 |
| 627641 | 1/1982 | Switzerland | 601/122 |
| 658989 | 12/1986 | Switzerland | 601/122 |
| 1277964 | 12/1986 | U.S.S.R. | 601/122 |

*Primary Examiner*—Danton D. DeMille

*Attorney, Agent, or Firm*—Bacon & Thomas

[57] ABSTRACT

A sole massaging device is set forth including three support members, a plurality of massaging rollers attached to the support members, and a locating frame for placing the structure in position. The support members are respectively provided with a plurality of holes into which opposite ends of shafts for the massaging rollers are fixed, and the massaging rollers are arranged in a wavelike pattern between the support members. Three horizontal shafts securely connect the support members by way of a plurality of fastening screws. The locating frame is movably fastened to the underside of the support members and can be folded or unfolded in position. An anti-skidding pad for stabilizing the device during operation is provided respectively on front and rear ends of the underside of the device. A plurality of massaging protuberances are provided on the massaging rollers for stimulating parts of a human body, especially the feet and hands.

4 Claims, 6 Drawing Sheets

SOLE MASSAGING DEVICE

FIELD OF THE INVENTION

The present invention relates generally to a massaging apparatus, and more particularly to a sole massaging device capable of stimulating various groups of nerve cells in the feet of a person to promote the physical condition and well-being of the person.

BACKGROUND OF THE INVENTION

It is believed and recognized by people at large that massage is an effective way to stimulate some specific body activities, to make muscles or joints supple, and to relieve tension. As a result, a variety of massaging devices, such as a massaging walkway and an electric massaging device, are in a great demand and are therefore widely available in the market place. The massaging walkway referred to above is a device on which a person walks back and forth with naked feet so as to stimulate the soles of the naked feet, thereby resulting in relaxation of the tired foot muscles. However, such a massaging walkway, as described above, is not particularly useful and helpful to a person who is too tired to walk after a hard-working day. In addition, it is rather inconvenient or even impossible for a person to read the paper or watch the television while walking on the massaging walkway. The electric massaging device referred to above is also limited in that it can be used only at a place where power is available, that the user would have to pay an additional cost for the electricity, and further that it is rather expensive for the user to buy and maintain such an electric massaging device.

A popular indoor activity known as a sauna is by no means an activity that is easily available to the public at an affordable cost.

SUMMARY OF THE INVENTION

It is therefore the primary objective of the present invention to provide a sole massaging device comprising mainly three support seats, a plurality of the massaging rollers, and a locating frame. The support seats are longitudinally arranged and are provided respectively in the inner side thereof with a plurality of position restricting slots or openings which are arranged at a predetermined interval and in a wavelike manner and are engageable respectively with a lug of position restricting plugs of a roller shaft on which a plurality of the massaging rollers are mounted. The roller shaft is provided thereon with a slide block engaging a groove of a roller collar so that small protuberances located on the outer surface of the roller collar are arranged in a predetermined manner to facilitate a uniform massaging effect on the sole. The massaging rollers are so arranged that even the sole plantar arch of a foot can be massaged effectively. The sole massaging device of the present invention can be operated without electricity and is safe to use at any locality. In addition, the user can read the newspaper or magazine or watch the television while sitting on a chair or sofa, with the soles of both feet sliding back and forth on the sole massaging device of the present invention. Simulation of the soles by the sole massaging device of the present invention can promote blood circulation, relaxation of muscles or joints, and relief of tension.

It is another objective of the present invention to provide a sole massaging device which comprises a locating frame fastened to the underside of the support seats and provided with a retaining slot engageable with a rail of the middle support seat. The retaining slot is provided with a retaining lug engageable securely with the retaining slot of a rail for preventing the detachment of the locating frame and for locating the sole massaging device of the present invention at a desired inclination. As a result, the sole massaging device of the present invention is a very handy travelling device on a long-distant flight or bus trip.

It is still another objective of the present invention to provide a sole massaging device with a plurality of anti-skidding pads fastened respectively with the front and rear ends of the undersides of the support seats for stabilizing the sole massaging device of the present invention during operation.

It is still another objective of the present invention to provide a sole massaging device, which can be also placed on a table to facilitate the massaging of the palms of both hands of a user so as to promote body metabolism of a user or to help keep user's body warm in a cold winter.

BRIEF DESCRIPTION OF THE DRAWINGS

The foregoing objectives, structures, functions and advantages of the present invention will be more readily understood upon a thoughtful deliberation of the following detailed description of the present invention in conjunction with the accompanying drawings.

DETAILED DESCRIPTION OF THE INVENTION

Figure 1:
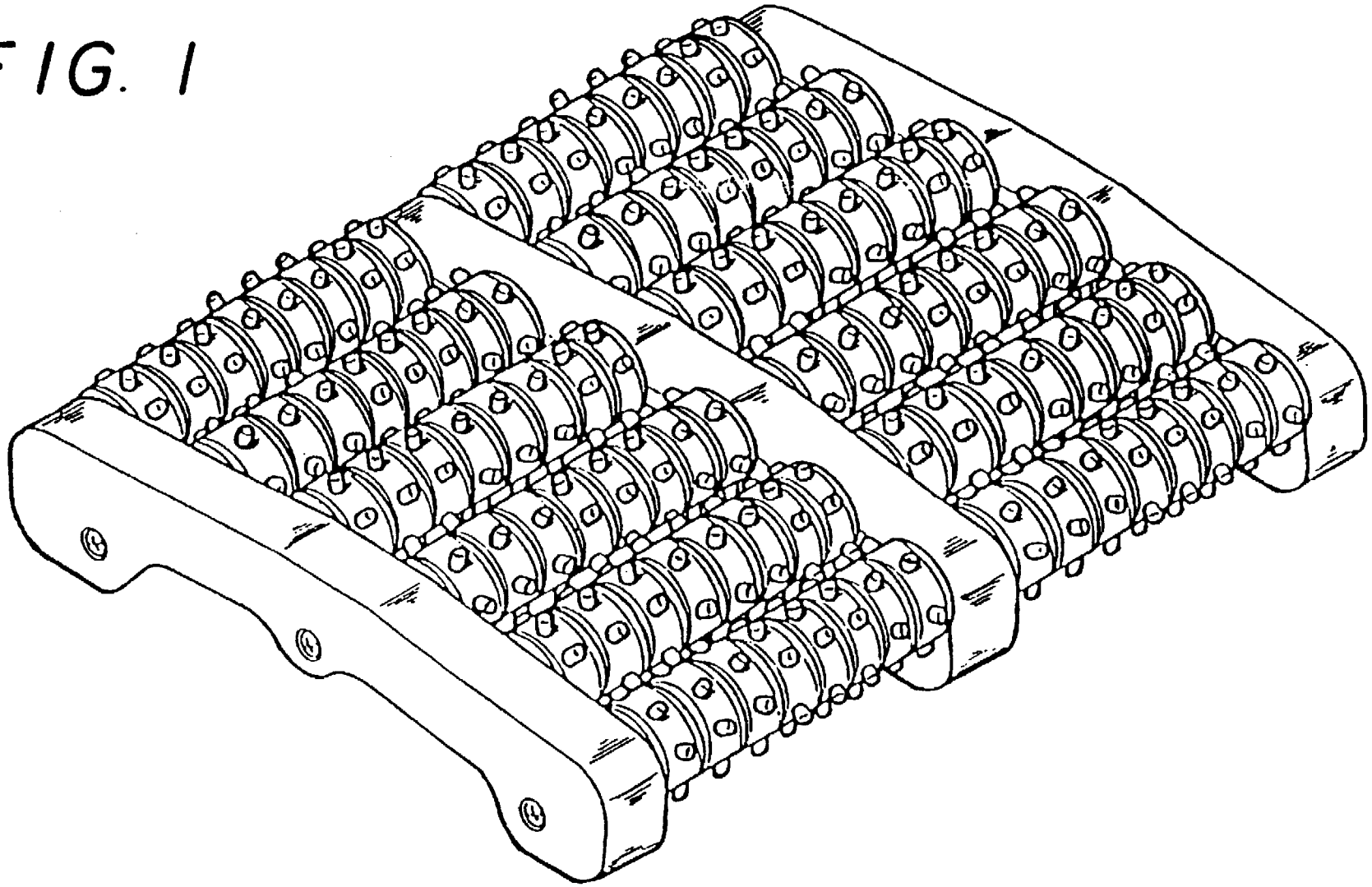
FIG. 1 shows a perspective view of a sole massaging device according to the present invention.
Figure 2:
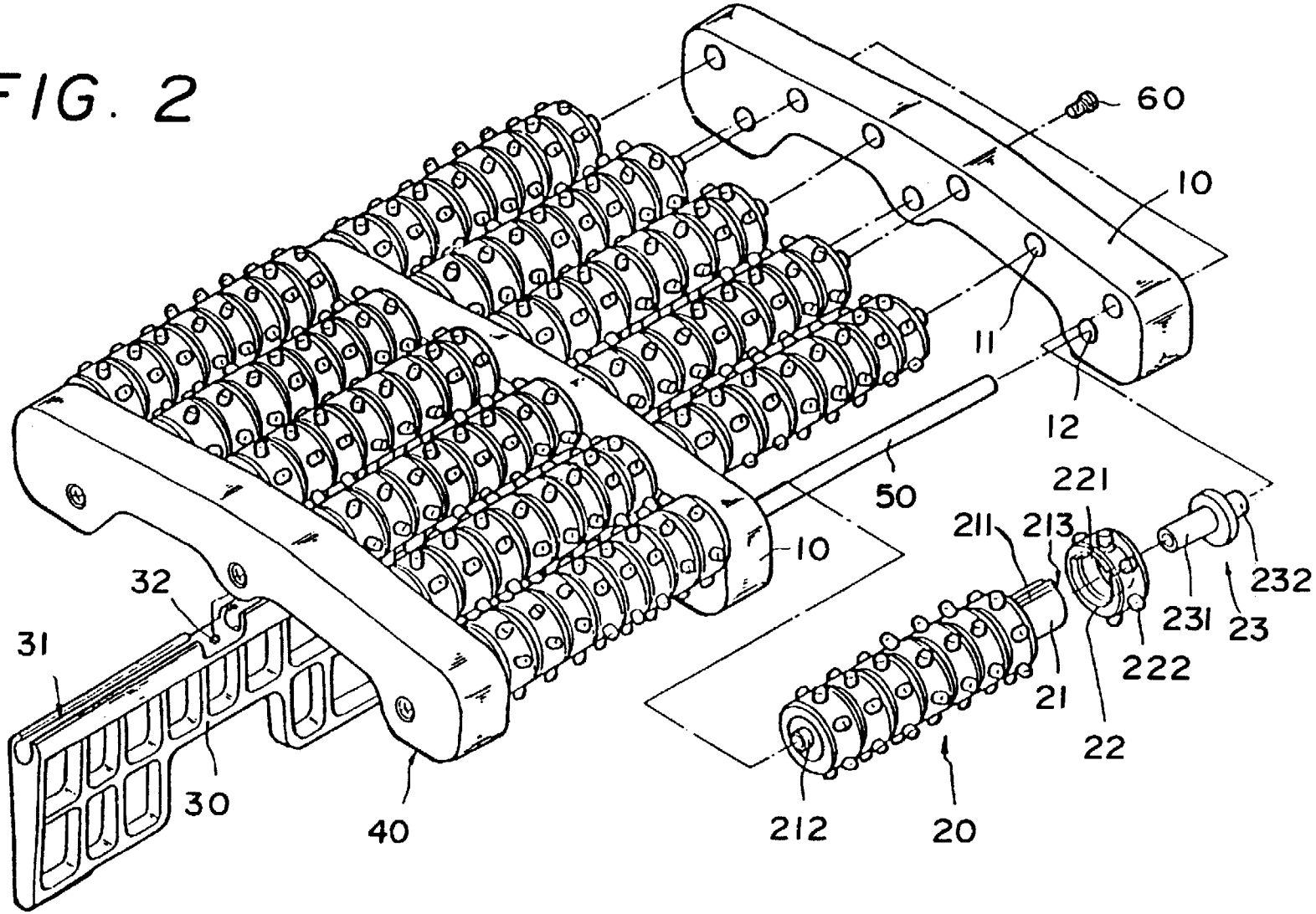
FIG. 2 shows an exploded view of the sole massaging device according to the present invention.
Figure 3A:
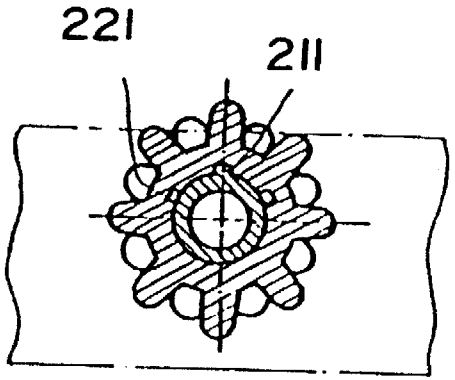
FIG. 3A shows a cross-sectional view of FIG. 3 at the line A—A.
Figure 3:
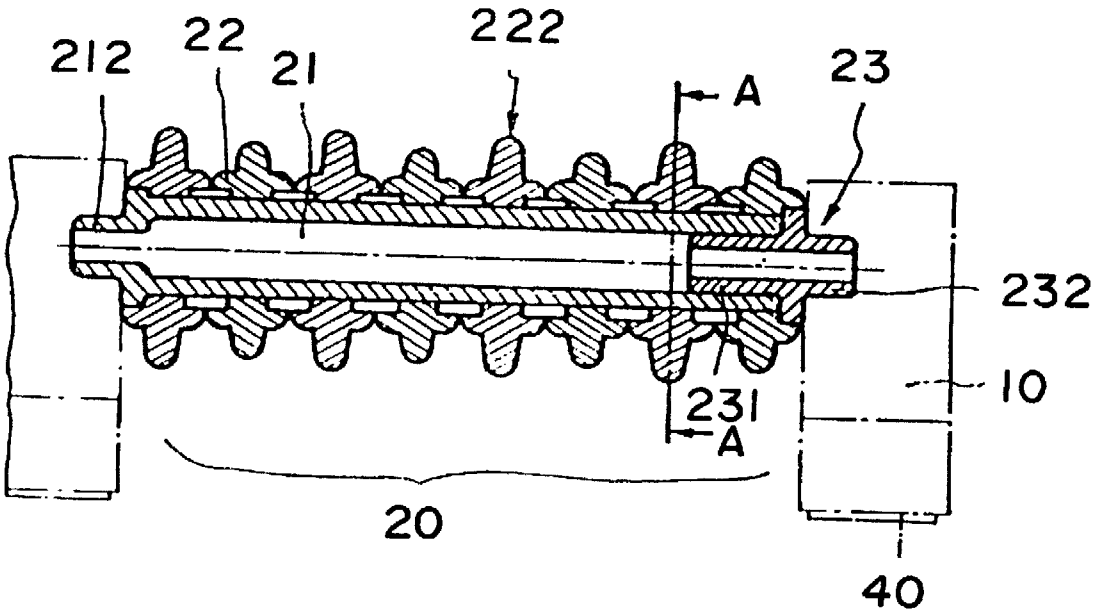
FIG. 3 includes a partial sectional view of the sole massaging device of the present invention.

As shown in FIGS. 1–3, the sole massaging device of the present invention comprises three longitudinally-arranged support seats 10, a plurality of massaging rollers 20, a locating frame 30, and a horizontal shaft 50. Two outer support seats 10 are provided respectively in the inner side thereof with a plurality of such holes 11 arranged at predetermined intervals while the middle support seat 10 is also provided respectively at both sides thereof with a plurality of such holes 11 arranged at a predetermined intervals. The holes 11 are arranged in a wavelike pattern such that the massaging rollers 20 are arranged at a predetermined inclination to facilitate the massaging of all parts of the sole of a foot. Each set of the massaging rollers 20 is provided at one end thereof with a lug 212 and at another end thereof with a hollow roller shaft 21 having thereon a slide block 211 engageable with grooves 221 of a roller collar 22 so that the small protuberances 222 located on the outer surface of the roller collar 22 can be arranged in a predetermined manner. The hollow roller shaft 21 is provided at the free end 213 thereof with a plug 23 having a tubular portion 231 dimensioned to fit into the axial hole of the free end 213. In other words, a massaging roller 20 is composed of a plurality of roller collars 22 mounted on the roller shaft 21. The lug 212 of the roller shaft 21 and the lugs 232 of the plug 23 are engageable with the holes 11 of the support seats 10. It must be noted here that the massaging rollers 20 are arranged between two support seats 10 in a wavelike manner so as to cooperate with the anatomy of the sole. The massaging rollers 20 can be arranged in a wavelike manner in view of the fact that the holes 11 of the support seats 10 are arranged similarly in a wavelike manner. Fastened by means of screws 60 to the support seats 10 are three horizontal shafts 50 serving to stabilize the massaging rollers 20, which are mounted between two support seats 10. It must be further noted here that the grooves 221 of the roller collar 22 are arranged at a predetermined angle.

As shown in FIG. 2, the support seats 10 are provided on the undersides thereof with a locating frame 30 fastened thereto and provided in an upper side thereof with a retaining slot 31. The locating frame 30 is confined to the area between both ends of the support seats 10. The retaining slot 31 of the locating frame is provided at the mid-segment thereof with a retaining lug 32 slidable on a rail 14 (see FIG. 5) of the middle support seat 10 and engageable securely with a receiving slot 13 (see FIG. 6) of the rail 14 so as to prevent the locating frame 30 from becoming disengaged from the support seat 10, as illustrated in FIG. 6. The locating frame 30 permits the user of the sole massaging device of the present invention to adjust the sole massaging device to be in a position that is most comfortable to the legs of the user. The support seats 10 are provided respectively on the underside thereof with a plurality of anti-skidding pads 40 for stabilizing the sole massaging device of the present invention during operation.

Figure 4:
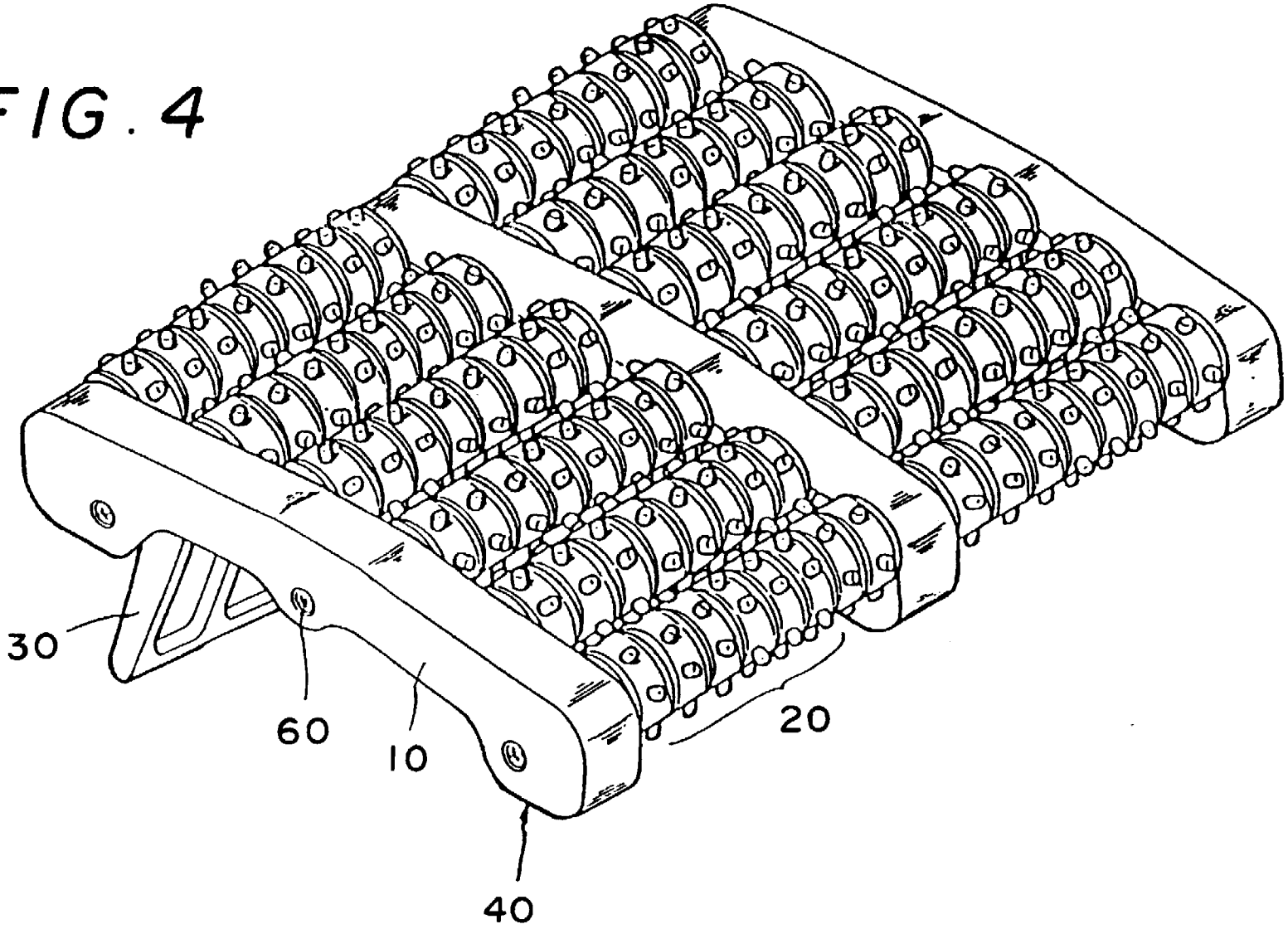
FIG. 4 shows a schematic view of an expanded locating frame of the sole massaging device of the present invention.
Figure 5:
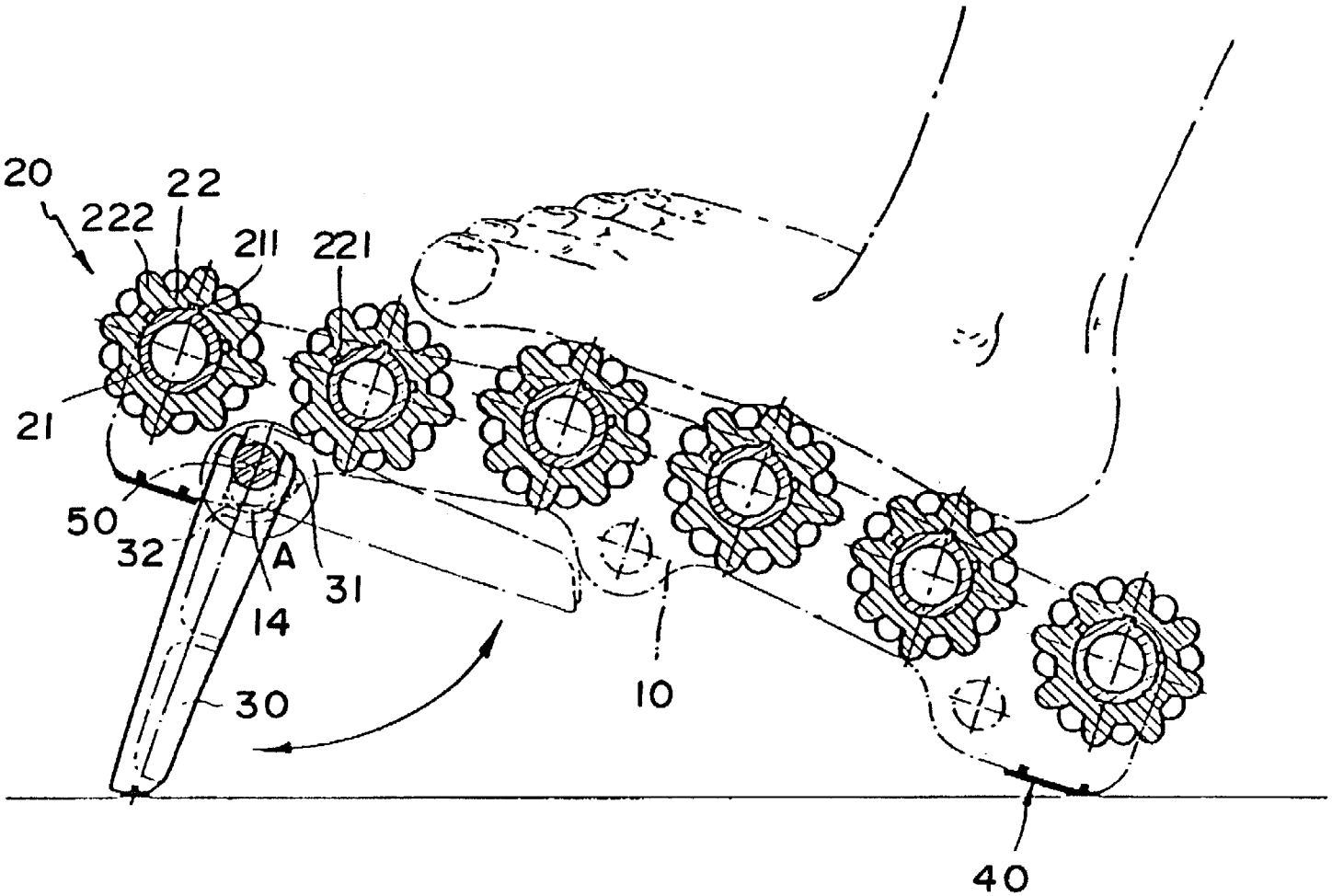
FIG. 5 shows a schematic view of the present invention at work.
Figure 6:
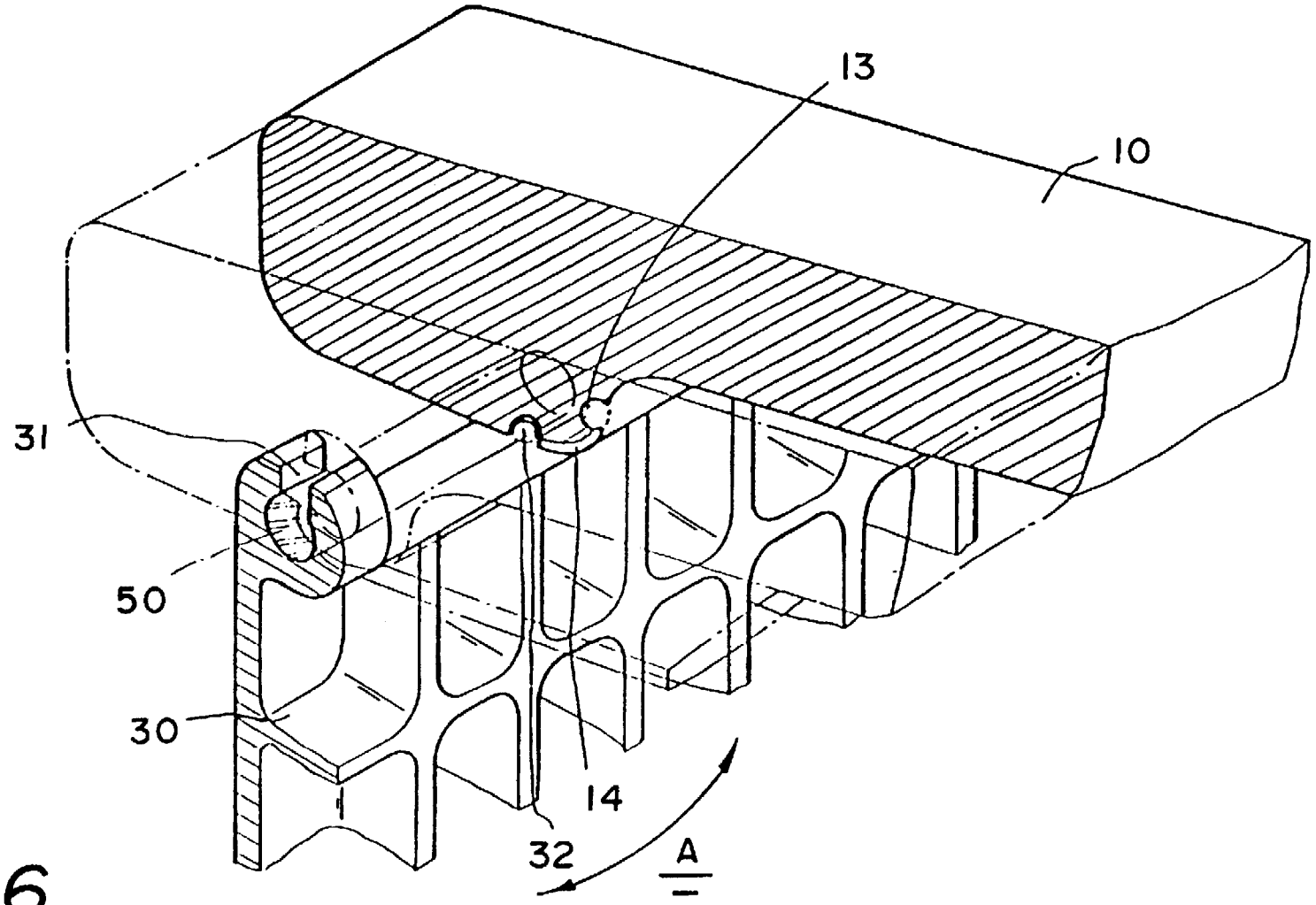
FIG. 6 shows a partial sectional view of the sole massaging device of the present invention.

As illustrated schematically in FIGS. 4 and 5, the sole massaging device of the present invention can be operated easily. In operation, the locating frame 30 is first unfolded to be placed on the surface of a floor. The user of the sole massaging device of the present invention can read a newspaper or watch television while doing massaging of the soles on the massaging rollers 20 of the present invention. The sole massaging device of the present invention is so portable that it can be used at any locality. Furthermore, the sole massaging device of the present invention can be operated without electricity and is therefore absolutely safe to use. The massaging rollers 20 of the present invention permit both legs of the user to move back and forth while doing the sole massaging, thereby preventing the leg muscles and the joints from becoming stiff. The small protuberances 222 provided on the surface of the massaging rollers 22 of the present invention serve to rub and stimulate the sole so as to promote blood circulation and body metabolism of the user of the present invention. The grooves 221 of the roller collar 22 are arranged at various angles so as to engage the slide block 211 of the roller shaft 21 in various ways. As a result, the small protuberances 222 of the massaging rollers 20 can be arranged in various combinations to facilitate massaging of all parts of the sole.

The sole massaging device of the present invention can be also used to massage the hands. The sole massaging device is placed on a table and the hand muscles are kneaded on the massaging rollers 20. Moreover, the sole massaging device of the present invention is an ideal travelling device for a frequent flyer. In a long trip, the compact sole massaging device of the present invention is most suitable for use in preventing both legs of a traveler from becoming stiff.

The sole massaging device of the present invention can be carried easily by a person because of the fact that the locating frame 30 of the sole massaging device of the present invention can be folded under the support seats 10 in such a manner that the retaining lugs 32 of the locating frame 30 are retained securely in the receiving slots 13 of the support seats 10, so that the locating frame 30 is secured to the support seats 10.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

I claim:

1. A massaging device, particularly for stimulating soles, comprising a support structure including three longitudinal members in separated parallel positions, two outer ones of said three longitudinal members having spaced holes along an inner wall while a third middle one of said three longitudinal members has matching spaced holes along facing walls thereof, said spaced holes being arranged with an inclination from a midsection of each of said members;

a plurality of massaging rollers, each of said rollers including a hollow shaft, a number of roller collars on said shaft, and a plurality of massaging protuberances on said roller collars;

slide blocks disposed on said shaft, said slide blocks engaging grooves of said roller collars to arrange said massaging protuberances in a predetermined manner;

retaining lugs at opposite ends of said shaft for engaging said spaced holes, said retaining lugs having an axial hole therein, and one of said retaining lugs at one end of said shaft including a plug inserted into said shaft at said one end;

wherein said massaging rollers are disposed in a wavelike pattern between said support structure; and fastening means securely fixing said three longitudinal members in position, said fastening means including a plurality of horizontal shafts threadedly connected to said two outer ones of said three longitudinal members.

2. A massaging device according to claim 1, further comprising a frame structure, wherein said frame structure is attached to said support structure, said frame structure having a retaining slot at a mid portion thereof to receive a projection slidably engaging a rail at the third middle one of said three longitudinal members, said projection being securely fixed with said receiving slot for preventing detachment of said frame structure from said third middle one of said three longitudinal members.

3. A massaging device according to claim 1, wherein anti-skidding pads are provided on opposite lower ends of said three longitudinal members.

4. A massaging device according to claim 1, wherein said grooves of said roller collars are arranged at various angles about said shaft.

* * * * *